US010337268B2

(12) United States Patent
Girola

(10) Patent No.: US 10,337,268 B2
(45) Date of Patent: Jul. 2, 2019

(54) DEVICE FOR ENSURING CONTINUOUS CIRCULATION IN WELL DRILLING

(71) Applicant: HAD ENGINEERING S.R.L., Saronno (IT)

(72) Inventor: Giorgio Girola, Cislago (IT)

(73) Assignee: HAD ENGINEERING S.R.L., Saronno (VA) (IT)

( * ) Notice: Subject to any disclaimer, the term of this patent is extended or adjusted under 35 U.S.C. 154(b) by 0 days.

(21) Appl. No.: 15/534,040

(22) PCT Filed: Dec. 14, 2015

(86) PCT No.: PCT/IB2015/059583
§ 371 (c)(1),
(2) Date: Jun. 8, 2017

(87) PCT Pub. No.: WO2016/097967
PCT Pub. Date: Jun. 23, 2016

(65) Prior Publication Data

US 2017/0342789 A1 Nov. 30, 2017

(30) Foreign Application Priority Data

Dec. 16, 2014 (IT) ..... MI2014A2158

(51) Int. Cl.
*E21B 19/16* (2006.01)
*E21B 21/10* (2006.01)
*E21B 34/00* (2006.01)

(52) U.S. Cl.
CPC ..... *E21B 21/106* (2013.01); *E21B 19/16* (2013.01); *E21B 34/00* (2013.01)

(58) Field of Classification Search
CPC ..... E21B 21/06; E21B 19/16; E21B 34/00
(Continued)

(56) References Cited

U.S. PATENT DOCUMENTS 3,298,385 A 1/1967 Jackson et al.
7,845,433 B2 12/2010 Calderoni et al.
(Continued)

FOREIGN PATENT DOCUMENTS

CN 102226382 A 10/2011
WO 2011047163 A2 4/2011

OTHER PUBLICATIONS

European Office Action issued in corresponding European Patent Application No. 14 738 627.0 dated May 16, 2018.
(Continued)

*Primary Examiner* — Taras P Bemko
(74) *Attorney, Agent, or Firm* — Davis & Bujold PLLC; Michael J. Bujold

(57) ABSTRACT

A device (1) for ensuring continuous circulation in well drilling includes a tubular body (2), having an axial channel (2) with a lateral opening (3) which is closed by a removable plug (5). A tubular support (9) is placed in the axial conduit and supports a shut-off member (6) which is held in position by a retainer (14). The device (1) has an adjustment ring nut (50) which exerts a pressing action between the retainer (14) and the tubular support (9) to force the tubular support (9) in an axial limit-stop position against respective positioning and centering elements (11), to allow recovery of clearances during placement of the tubular support (9) and the valve (6) supported the tubular support inside the tubular body (2).

19 Claims, 10 Drawing Sheets

(58) Field of Classification Search
USPC ..... 175/218
See application file for complete search history.

(56) References Cited

U.S. PATENT DOCUMENTS

| | | | | |
|---|---|---|---|---|
| 2006/0278434 | A1* | 12/2006 | Calderoni | E21B 21/106 175/57 |
| 2009/0071654 | A1* | 3/2009 | O'Malley | E21B 34/105 166/323 |
| 2009/0242817 | A1 | 10/2009 | Strazhgorodskiy | |
| 2010/0084142 | A1* | 4/2010 | Calderoni | A61K 31/385 166/380 |
| 2011/0088907 | A1 | 4/2011 | Xu | |
| 2011/0155379 | A1* | 6/2011 | Bailey | E21B 19/16 166/324 |

OTHER PUBLICATIONS

Second Eurasian Office Action issued in corresponding Eurasian Patent Application No. 201592201 dated Feb. 13, 2018.
Second Chinese Office Action issued in corresponding Chinese Patent Application No. 201480034124.X dated Apr. 24, 2018.
Written Opinion filed in corresponding PCT Application No. PCT/IB2015/059583 dated Mar. 15, 2016.
International Search Report filed in corresponding PCT Application No. PCT/IB2015/059583 dated Mar. 15, 2016.
Italian Search Report filed in corresponding Italian Application No. MI2014A002158 dated Aug. 5, 2015.

* cited by examiner

DEVICE FOR ENSURING CONTINUOUS CIRCULATION IN WELL DRILLING

This application is a national stage completion of PCT/IB2015/059583 filed Dec. 14, 2015 which claims priority from Italian Application Serial No. MI2014A002158 filed Dec. 16, 2014.

FIELD OF THE INVENTION

The present invention relates to a device, for ensuring continuous circulation in well drilling, particularly during insertion or removal of a drill string in wells for hydrocarbon exploration and production.

For simplicity, the present disclosure will be made without limitation with particular reference to the step of insertion of a new drill string, the same considerations being also applicable to the step of removal of drill strings, when the drilling bit must be removed from the well, e.g. for replacement.

BACKGROUND OF THE INVENTION

When drilling a hydrocarbon well, the process of insertion of a drill string is required for increasing the well drilling depth.

During insertion of a new string, continuous circulation of drilling mud must be ensured throughout the process until a complete pipe is obtained and the whole hydraulic circuit is restored. Indeed, pressure drops or variations in mud circulation have been found to cause considerable structural stresses in the well being drilled, which involve collapse in encased structures of the well being drilled.

In order to ensure such continuous circulation of drilling mud throughout the drilling process, and hence also during the steps of insertion of new drill strings or removal of existing strings, devices have been long provided, for ensuring steady circulation of drilling mud even during insertion or removal of a drill string.

A device of the aforementioned type is disclosed in the prior art document U.S. Pat. No. 3,298,385. Particularly, this prior art document shows the possibility of using a flapper valve having a single shut-off member for selectively regulating the passage of the drilling mud through the central axial conduit of the valve or, alternatively, through a lateral passage interposed between opposite ends of the valve.

The technical solution of using a single shut-off member to provide the aforementioned selective regulation of the passage of the drilling mud through the central axial conduit of the valve or, alternatively, through the lateral passage, is preferred over the use of two distinct shut-off members, as disclosed, for instance, in the prior art document U.S. Pat. No. 7,845,433, amongst other things due to the fact that there is no uncertainty about the closing position assumed by the single shut-off member.

Nevertheless, it shall be noted that, while the use of a single shut-off member to alternatively close either the central axial conduct of the valve or the aforementioned lateral passage interposed between the opposite ends of the valve provides advantages in terms of operation, it poses serious problems concerning proper positioning and centering of the body of the shut-off member within the central axial conduit of the valve. This is because the single shut-off member must be able to ensure a tight sealing effect, both in a first angular position, with the seat of the shut-off member oriented transverse to the axis of the valve, and in a second angular position, with the seat of the shut-off member longitudinally extending along the axis of the valve. Therefore, even a minor angular or axial positioning error with respect to the valve body may cause an imperfect sealing action of the shut-off member in at least one of the two seats of the shut-off member, which is not compatible with the high pressures of the drilling mud.

Particularly proper axial positioning of the body of the shut-off member and the point at which it is hinged to the valve body is problematic. In an attempt to tackle this problem, the valve body and the parts that form the moving shut-off assembly should be formed with very strict processing tolerances but sometimes this has not been practically found to be sufficient. During assembly of the valve and the moving shut-off member therein, the processing tolerances of the various parts may sum up and sometimes cause imperfect closure of the shut-off member in both seats of the shut-off member.

For the aforementioned reasons, these valves comprising a single shut-off member have not gained success in this field heretofore.

Therefore, there is an unfulfilled need of ensuring proper closing operation of the shut-off member in both closing positions, irrespective of any particular critical condition that may be encountered during assembly due to the summation of the tolerances of the various connections that have been made.

SUMMARY OF THE INVENTION

The present invention is based on the problem of conceiving a device for ensuring continuous circulation in well drilling, particularly during insertion or removal of a drill string into and out of wells for hydrocarbon exploration and production, that has such structural and functional characteristics as to fulfill the above need, without being affected by the aforementioned prior art problems.

This problem is solved by a device for ensuring continuous circulation in well drilling as defined in the claims.

BRIEF DESCRIPTION OF THE DRAWINGS

Further characteristics and advantages of the device of the present invention for ensuring continuous circulation in well drilling will be apparent from the following description of a few preferred embodiments thereof, which are given by way of illustration and without limitation with reference to the accompanying figures, in which.

DETAILED DESCRIPTION OF THE PREFERRED EMBODIMENTS

Figure 1:
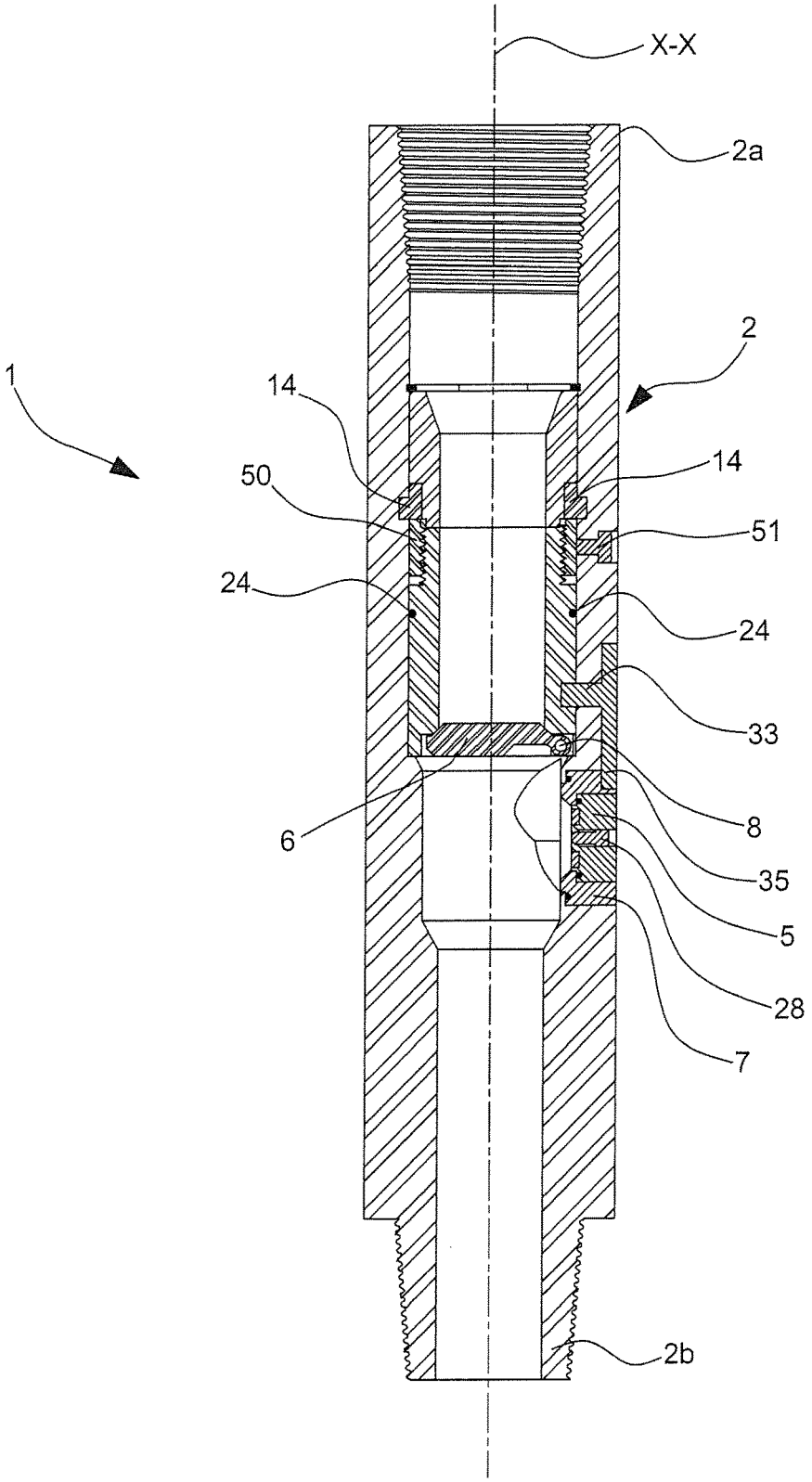
FIG. 1 shows a simplified plane longitudinal sectional view of the device of the invention, with the lateral conduit closed by the shut-off member in a longitudinal position.

Referring to the accompanying figures, numeral 1 generally designates an inventive device for ensuring continuous circulation in well drilling, namely a device for ensuring continuous circulation in well drilling particularly during insertion or removal of a drill string into or out of wells for hydrocarbon exploration and production.

The device 1 comprises:

- a substantially tubular body 2 extending in a preset axial direction X-X from an upstream end 2*a* to a downstream end 2*b*, the tubular body 2 being shown as having a circular cylindrical section;
- an axial conduit extending from the upstream end 2*a* to the downstream end 2*b*, for drilling mud to flow there through in the device 1;
- first threaded connection means at the upstream end 2*a* for connection of the downstream end 2*b* of the device 1 to one end of a drill string;
- second threaded connection means at the downstream end 2*b* for connection of the downstream end 2*b* of the device 1 to one end of a drill string;
- a lateral opening 3 located in the tubular body 2 between the upstream end 2*a* and the downstream end 2*b* to define a lateral conduit in the device 1, in fluid communication with the aforementioned axial conduit, the axial conduit having an axis Y-Y which is preferably perpendicular to the axis X-X of the axial conduit;
- a plug 5 removably fitted into the lateral opening 3 in a pressure-tight manner by a threaded nut-screw engagement;
- valve means 6 located in the axial conduit to block the drilling mud and stop its flow from the upstream end 2*a* to the downstream end 2*b*; wherein:
- the aforementioned valve means comprise a shut-off member 6 that is movably supported in the axial conduit to move from a position transverse to the axial conduit (see FIGS. 1, 9), in which the shut-off member 6 extends transverse to the axis of the axial conduit to stop fluid continuity between the upstream end 2*a* and the downstream end 2*b* in the axial conduit, and a longitudinal position relative to the axial conduit (see FIGS. 2, 4, 5), in which the shut-off member 6 substantially extends along the axis of the axial conduit and is located close to a side wall portion within the tubular body 2;
- in such transverse position (see FIGS. 1, 9) the shut-off member 6 is located between the lateral conduit and the upstream end 2*a* of the tubular body 2 to be placed upstream from the aforementioned lateral opening 3, relative to the flow of the drilling mud in the axial conduit from the upstream end 2*a* to the downstream end 2*b* and
- in such longitudinal position (see FIGS. 2, 4, 5) the shut-off member 6 closes in a pressure-tight manner the lateral opening 3 to stop fluid continuity between the lateral conduit and the axial channel of the tubular body.

Concerning drill strings, it shall be noted that, according to an applicable industry standard, these have a male threaded lower end and an opposed nut threaded upper end, which is designed for nut-screw engagement with the lower end of another drill string. According to this standard, in the device 1 the first screw connection means of the upstream end 2*a* consist of a nut screw, and the second screw connection means of the downstream end 2*b* consist of male screw threads, said nut screw and said male screw threads being equal to said nut threads and said male screw threads provided at the upper and lower ends respectively of each drill string.

At the lateral opening 3, the tubular body 2 of the device 1 has a seat for the shut-off member which is designed for pressure-tight engagement by the shut-off member 6, when such shut-off member is in the aforementioned longitudinal position (see FIGS. 2, 4, 5), such seat for the shut-off member allowing the lateral opening 3 and the lateral channel defined thereby to be closed in a pressure-tight manner, as mentioned above.

Preferably, such seat for the shut-off member is an inserted seat 7, and is associated in integral and pressure-tight fashion with the tubular body 2. In accordance with the illustrated embodiments, the inserted seat 7 for the shut-off member is defined by a threaded ring nut, having:

- an outer portion with male screw threads, for pressure-tight nut-screw engagement with corresponding nut threads provided at the lateral opening 3, and
- an inner portion with nut threads, for pressure-tight screw engagement with the male screw threads of the plug 5.

Alternatively, the above-mentioned inserted seat for the shut-off member may be formed as a one-piece with the tubular body 2, and an inserted seat for the shut-off member welded to the tubular body or secured thereto in a manner other than the above described screw connection, may be also used.

Similarly, it shall be noted that the screw engagement between the plug 55 and the inserted seat 7 for the shut-off member is a preferred embodiment, although different removable pressure-tight connection arrangements may be provided.

In any case, the inserted seat 7 and the plug 5 should have small dimensions, and be at the most flush with the footprint of the outer wall of the tubular body 2, to prevent any radially projecting portion of the tubular body 2 of the device from creating interferences in the well being drilled.

Preferably, the shut-off member 6 comprises a convex, preferably a partially spherical portion/wall, whose convexity faces the lateral opening 3. This spherical portion/wall engages such inserted seat 7 for the shut-off member in a pressure-tight manner, when the shut-off member 6 is in the aforementioned longitudinal position (see FIGS. 2, 4, 5).

Preferably, the above-mentioned valve means consist of a flapper valve having a diaphragm shut-off member 6, which is connected by hinge connection means, at a peripheral portion thereof, to an axis of rotation 8, said diaphragm 6 moving from such longitudinal position (see FIGS. 2, 4, 5) to said transverse position (see FIGS. 1, 9), and vice versa, by rotating about said axis of rotation 8. Such axis of rotation 8:

- extends transverse, preferably perpendicular, to the longitudinal axis X-X of said axial conduit;
- is placed close to the inner wall of said tubular body 2;
- is circumferentially placed to be substantially located at said lateral opening 3 and
- is located substantially proximate to said lateral opening 3 in the portion of the tubular body 2 located between said lateral opening 3 and the upstream end 2*a* of the tubular body 2, As a result, when the tubular body 2 is placed with the longitudinal axis substantially in a vertical orientation, with the upstream end 2*a* located at a higher level than the downstream end 2*b:* the aforementioned hinge connection means and the axis of rotation 8 are placed above the through opening 3 and, due to its weight force the shut-off member 6 tends to move to the aforementioned longitudinal position (see FIGS. 2, 4, 5) in which it seals the lateral opening 3.

According to both embodiments of the figures, the shut-off member 6 and the hinge connection means are supported by a tubular support 9 for the shut-off member, which is concentrically fitted in a pressure-tight manner into the tubular conduit defined in the tubular body 2 from the upstream end 2*a* to an axial limit-stop position as defined by an inner annular shoulder 34 of the tubular body 2.

The device 1 is also equipped with positioning and centering means 11, which are adapted to ensure proper axial and angular positioning of the tubular support 9 within the tubular body 2 by abutment against the aforementioned inner annular shoulder 34.

The positioning and centering means may be formed in accordance with different possible functionally and/or structurally equivalent embodiments. Thus, for example, according to the illustrated embodiment, the above positioning and centering means 11 comprise:

a through hole 31 provided in the wall of the tubular body 2 perpendicular to the axis X-X, a blind hole 32 provided in the outer wall of the tubular support 9 perpendicular to the axis X-X and a pin 33 adapted to fit into the through hole 31 of the tubular body 2 to engagement of the blind hole 32 of the tubular support.

The through hole 31 and the blind hole 32 are placed in such positions relative to the tubular body 2 and the tubular support 9, as to be exactly aligned when the tubular support 9 is properly angularly rotated about the axis X-X of the axial conduit such that, in the aforementioned longitudinal position (see FIGS. 2, 4, 5), the shut-off member 6 is located over said lateral opening 3 (namely in pressure-tight engagement relationship with the seat 7 for the shut-off member) for pressure-tight closure thereof.

Therefore, the engagement of the pin 33 in the through hole 31 and the blind hole 32 confirms proper positioning of the tubular support 9 in the tubular conduit 2. It shall be noted that the proper depth of insertion of the tubular support 9 in the axial channel of the tubular body 2 is ensured by abutment of the head end 9*b* of the tubular support 9 against an inner annular shoulder 34 of the tubular body 2.

The aforementioned pin 33 is carried by a support plate 35, which is mounted to the tubular body 2 from the outside by means of fastening screws. For this purpose, a seat 37 is provided in the outer wall of the tubular body 2 for receiving the support plate 35, the insertion of the support plate 35 in the receiving seat 37 confirming that the pin 33 is also inserted in the blind hole 32 of the tubular support 9 and hence that the tubular support 9 is properly positioned (both axially and angularly) within the tubular body 2.

Preferably, the aforementioned support plate 35 axially extends to engagement of an outer seat for the removable plug 5, thereby also acting as a safety feature to prevent rotation and hence loosening of the removable plug 5.

As shown in the figures, seal means 24 are provided between the tubular support 9 and the inner tubular wall of the tubular body, to afford pressure tightness. For this purpose, an annular seat is provided in the exterior of the tubular support 9, in which the seal means 24 are housed in outwardly projecting arrangement for interference with the inner tubular wall of the tubular body 2.

The device 1 further comprises retainer means 13 for maintaining the tubular support 9 inserted in the axial conduit, in the aforementioned limit stop axial position.

These retainer means 13 comprise:

a plurality of retainer elements 14, placed in said tubular conduit in a circumferentially offset position and close to the head end 9*a* of the tubular support 9 facing the upstream end 2*a* of the tubular body 2, said retainer elements 14 acting as retainer means to prevent the tubular support 9 from axially moving toward the upstream end 2*a* of the tubular body 2;

an inner seat 15 provided in the inner tubular wall of said tubular body 2, which only houses a first portion 14*a* of the retainer elements 14, a second portion 14*b* of the retainer elements 14 projecting out of the inner tubular wall of the tubular body 2 into the axial channel and a locking guide 16 for maintaining said first portion of the retainer elements within the inner seat 15.

According to the illustrated embodiment, the retainer elements 14 comprise circumferential sectors having a substantially L-shaped cross section, wherein a first branch of the L shape defines the aforementioned first portion 14*a* inserted in said groove 15, whereas the second branch of the L shape defines said second portion 14*b* that defines the inner shoulder, acted upon by the adjustment pressing/pushing member 50.

Preferably, the aforementioned circumferential sectors 14 are oriented such that the aforementioned second branch 14*b* of the L shape will extend from the first branch 14*a* of the L shape toward the upstream end 2*a* of the tubular body 2.

Advantageously, the device 1 comprises an adjustment pressing/pushing member 50, wherein:

said adjustment pressing/pushing member 50 is coaxially associated in kinematic nut-screw engagement with the tubular support 9, such that a relative rotation of said adjustment pressing/pushing member 50 in a first direction or in the opposite direction with respect to said tubular support 9 corresponds to a relative displacement of said adjustment pressing/pushing member 50 along the axis X-X, in a first direction or in the opposite direction with respect to the tubular support 9;

following a relative rotation of the adjustment pressing/pushing member 50 with respect to the tubular support 9, the adjustment pressing/pushing member 50 reversibly moves along the axis X-X, from a more retracted position relative to the upstream end 2*a* toward a more advanced position with respect to said upstream end 2*a* of the tubular body, and vice-versa;

when the adjustment pressing/pushing member 50 is in the aforementioned more retracted position it does not interfere with the retainer elements 14, as it is at a longer distance from the upstream end 2*a* of the tubular body 2 than the retainer elements 14;

the aforementioned inner shoulder defined in the tubular conduit 2 by the retainer elements 14 defines a limit-stop abutment against the movement of the adjustment pressing/pushing member 50 toward the aforementioned more advanced position.

In view of the above, when the device 1 is properly mounted, the adjustment pressing/pushing member 50 is rotated relative to the tubular member 9 for the adjustment pressing/pushing member 50 to be moved closer to the upstream end 2*a* of the tubular body 2. This movement stops before the adjustment pressing/pushing member 50 reaches the aforementioned more advanced position. Namely, this movement stops when the adjustment pressing/pushing member 50 abuts and is forced against the aforementioned inner shoulder defined in the tubular conduit 2. Due to such abutment:

- the retainer elements 14 can be forced into the inner seat 15 toward the upstream end 2*a* of the tubular body and, at the same time,
- the tubular support 9 can be forced into the axial limit-stop position against said positioning and centering means 11.

This will afford effective recovery of the clearances in positioning the tubular support 9 and the means 6 supported thereby inside the tubular body 2.

According to a preferred embodiment:

- the aforementioned adjustment pressing/pushing member 50 is a threaded ring nut and
- the aforementioned head end 9*a* of the tubular support 9 facing toward said upstream end 2*a* of the tubular body 2 has threads for coupling with said threaded ring nut by nut-screw engagement.

Preferably, the device 1 comprises stop means which act upon the adjustment pressing/pushing member 50 to reversibly lock the angular position of said adjustment pressing/pushing member 50 with respect to the tubular element 9, to thereby prevent rotation and consequent axial displacement of the adjustment pressing/pushing member 50 with respect to the tubular body 9.

According to the illustrated embodiment, the aforementioned stop means comprise a locking pin 51 which is inserted in a through opening 52 formed in the tubular wall of the tubular body 2 level with the adjustment pressing/pushing member 4 and transverse, preferably perpendicular to the axis X-X of the tubular element 2. Such locking pin 41 abuts with a predetermined pre-load against the outer cylindrical wall of the adjustment pressing/pushing member 50 to prevent rotation thereof about the axis (X-X). In the illustrated example, the locking pin 51 is force-fitted into said through opening 52, although other coupling forms may be provided, such as a threaded nut-screw engagement.

According to a preferred embodiment, the outer cylindrical wall of the adjustment pressing/pushing member 50 has a plurality of grooves (not shown for simplicity) which extend parallel to the axis and, accordingly, the free end of the locking pin 51 which is designed to contact the adjustment pressing/pushing member 50 also has a corresponding series of grooves (not shown). The coupling between the aforementioned grooves of the outer cylindrical wall of the adjustment pressing/pushing member 50 and the free end of the locking pin 51 helps to prevent any rotation of the adjustment pressing/pushing member 50 about the axis X-X.

According to an embodiment that is not shown, the retainer elements 14 may be other than the above described circumferential sectors. Thus, for example, there may be a great number of (at least ten) retainer elements in the form of spherical elements, elements with spherical-surface portions or rollers with their axes parallel to the longitudinal axis X-X of the tubular body 2. These retainer elements are also at a convenient distance, i.e. spaced, from each other in the circumferential direction, and define together the aforementioned annular retainer element whose inside diameter is smaller than the inside diameter of the lateral opening 3. It shall be noted that, also in this case, the aforementioned plurality of retainer elements can accomplish as a whole an effective and uniform retaining action for the aforementioned adjustment pressing/pushing member 50.

Preferably, the aforementioned inner seat 15 comprises a profile that matches the profile of the first portion of the retainer elements inserted therein.

Preferably, a circumferential groove is provided in the aforementioned inner annular seat 15, for receiving magnets, preferably in the form of annular sectors or an open ring, whereby the retainer elements 14 can be held in position in the inner annular seat 15 during assembly of the device 1, namely prior to positioning of the locking guide 16.

Instead of or in addition to the provision of the aforementioned magnets in the inner annular seat 15, the retainer elements 14 may be provided themselves in the form of magnetic elements. This may be achieved by magnetizing the retainer elements 14 or associating magnets therewith.

Concerning the aforementioned locking guide 16 for locking the retainer elements 14, it will be appreciated that it may be conveniently held in position within the tubular conduit 2, against the inner wall of the tubular conduit 2, using a Seeger ring 19, which partially engages an inner circumferential groove 20 provided in the inner tubular wall of the tubular body 2.

The outer tubular wall of the locking guide 16 comprises a circumferential groove (not shown), in which an O-ring is housed with a portion projecting outwards. This O-ring provides pressure-tightness between the outer annular wall of the locking guide 16 and the inner wall of the tubular conduit 2.

Figure 9:
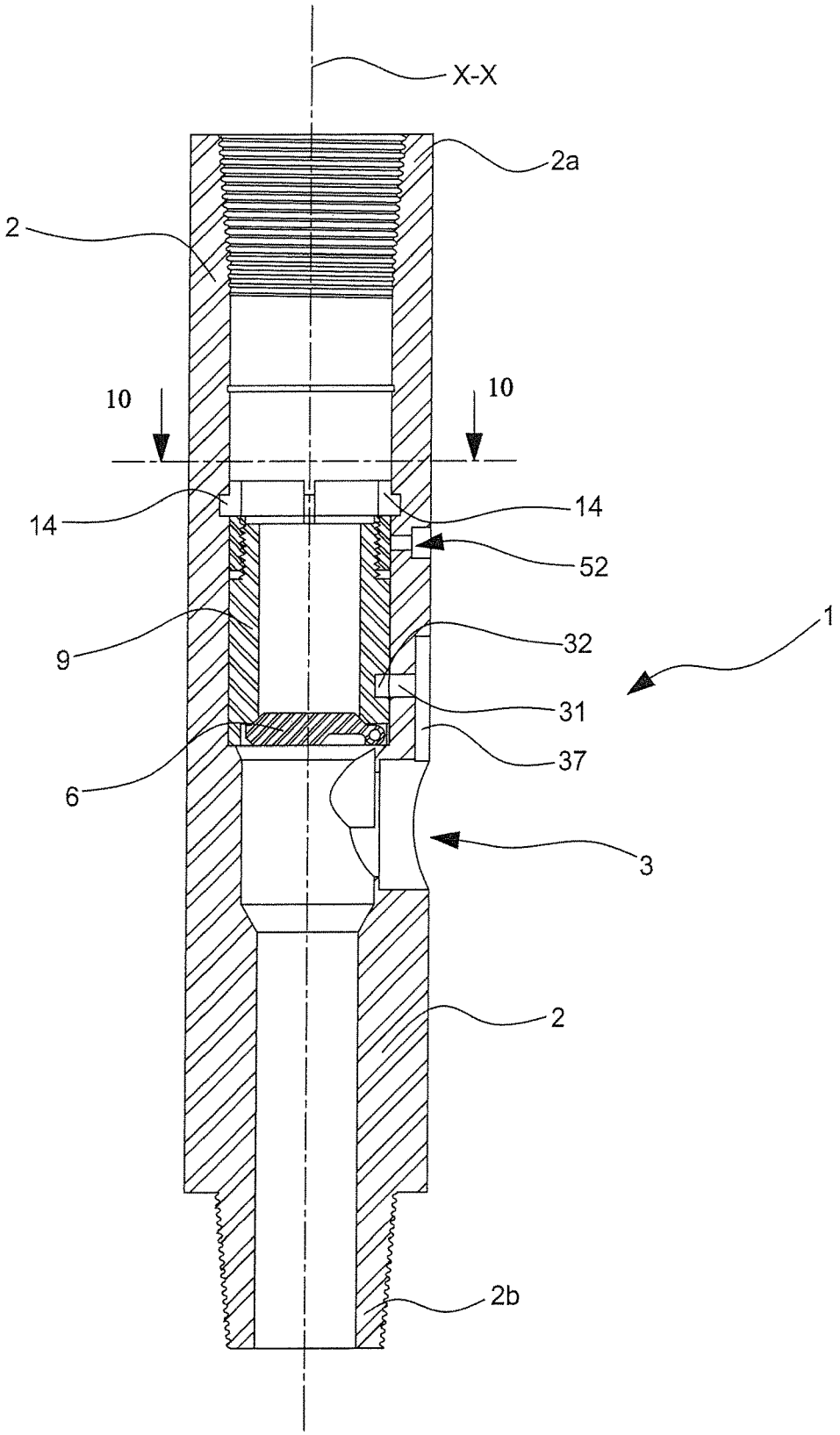
FIG. 9 shows a longitudinal sectional plane view of the device of FIG. 1 with the locking guide and its Seeger ring removed.
Figure 10:
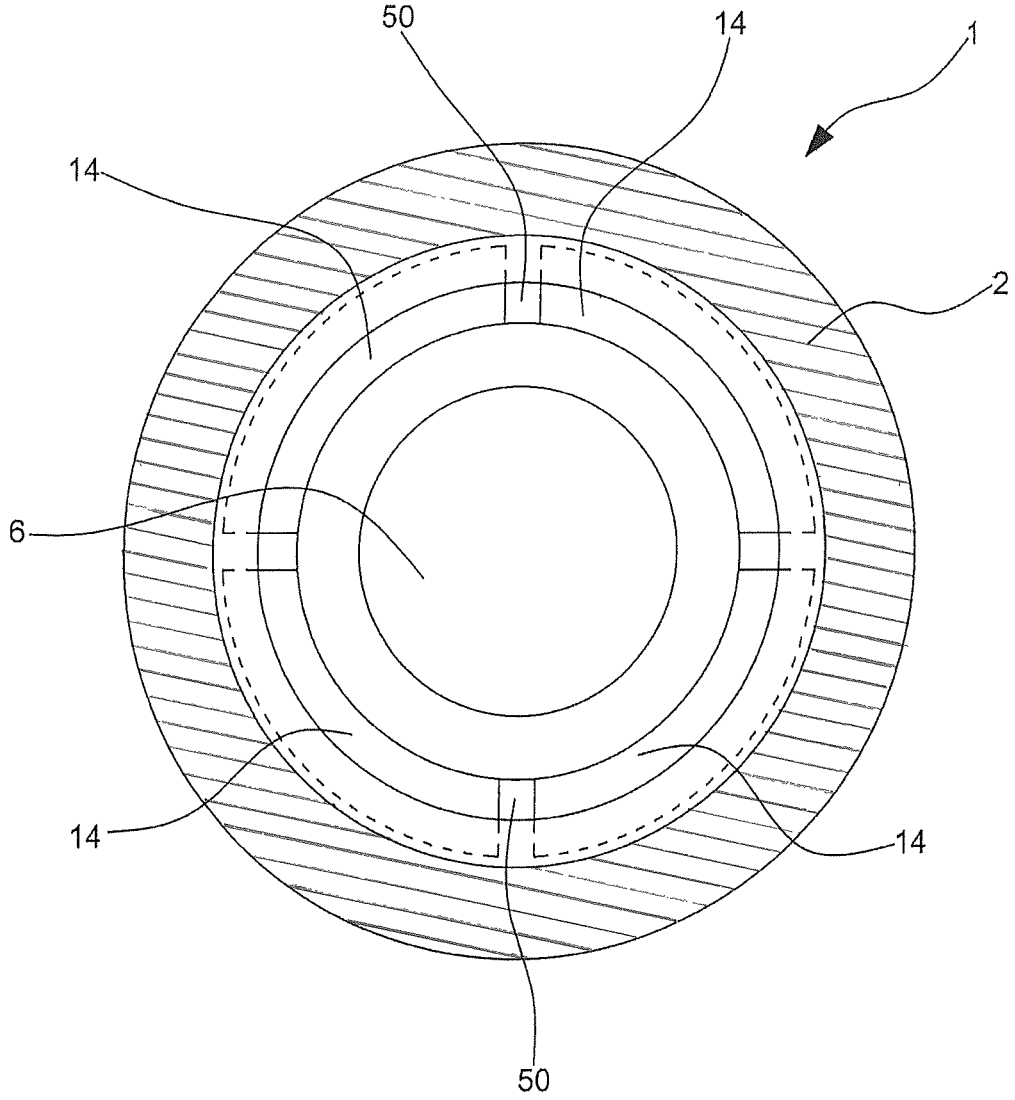
FIG. 10 shows a sectional view taken along line 10-10 of FIG. 9.

Preferably, the device 1 comprises magnetic means 22 for exerting an attractive force on the shut-off member 6 in the longitudinal position (see FIGS. 2, 4, 5), or in a position proximate thereto, and/or for holding it in said longitudinal position with a preset force, such that only when a force that can exceed such magnetic attractive force is exerted on the shut-off member 6, such shut-off member 6 may be moved toward the aforementioned transverse position (see FIGS. 1, 9).

Preferably, these magnetic means 22 have a ring shape, although magnets having the shape of annular sectors, disks or others may be used and placed on/in the plug 5.

According to the illustrated embodiments, these magnetic means are carried by the plug 5, preferably by the inner side of the plug 5, i.e. the side of the plug 5 that faces the aforementioned axial channel when the plug 5 is applied to close the lateral opening 3 in a pressure-tight manner.

According to an embodiment that is not shown in the figures, the aforementioned magnetic means may comprise one or more magnets carried by the shut-off member at the side of the shut-off member 6 that faces the lateral opening 3 when the shut-off member 6 is in the aforementioned longitudinal position, whereby such magnets may interact with the inner wall of the tubular body 2, with the seat 7 for the shut-off member and/or preferably with a portion of the plug 5. These magnetic means may also preferably have a ring shape and are applied to the side of the shut-off member 6 that faces the lateral opening 3 when the shut-off member 6 is in the longitudinal position. This is particularly advantageous when the shut-off member 6 has a substantially circular shape, because the magnetic ring may be applied to the shut-off member 6 in concentric arrangement.

Figure 2:
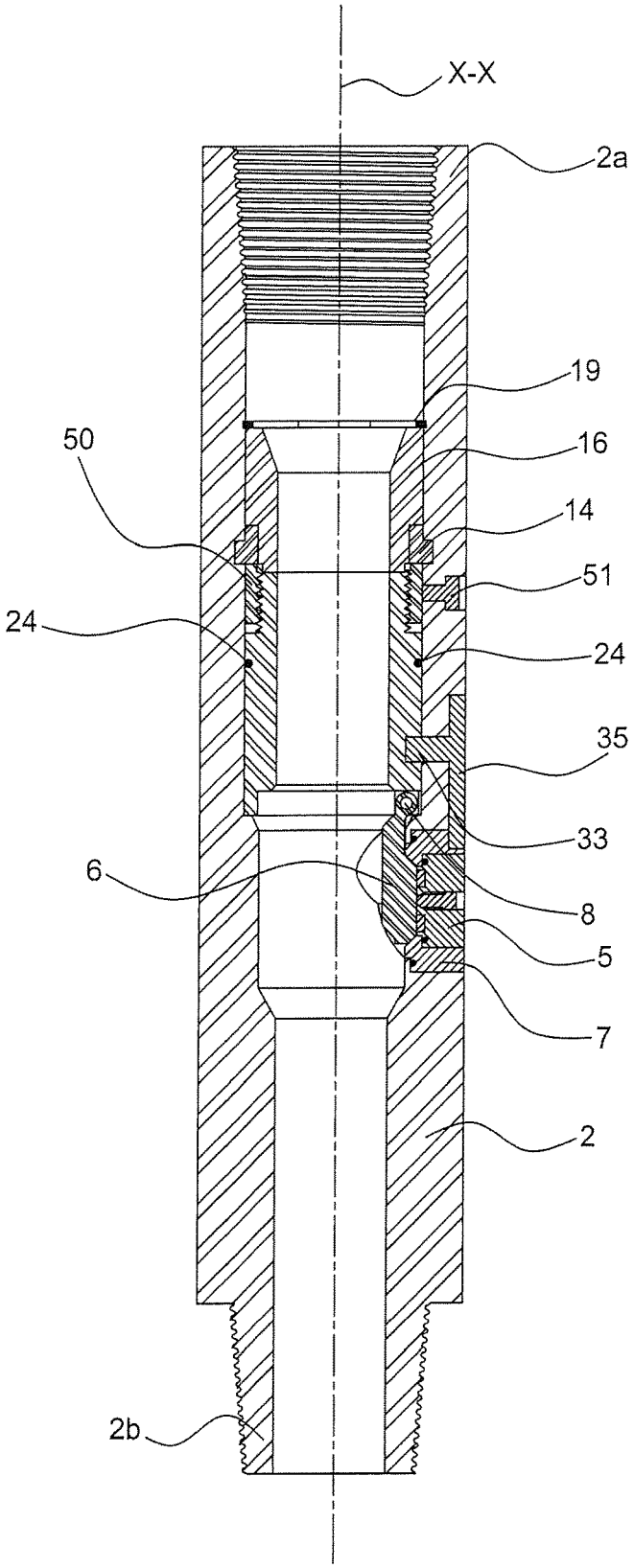
FIG. 2 shows a longitudinal sectional view of the device of FIG. 1, with the axial conduit closed by the shut-off member in a transverse position.
Figure 3:
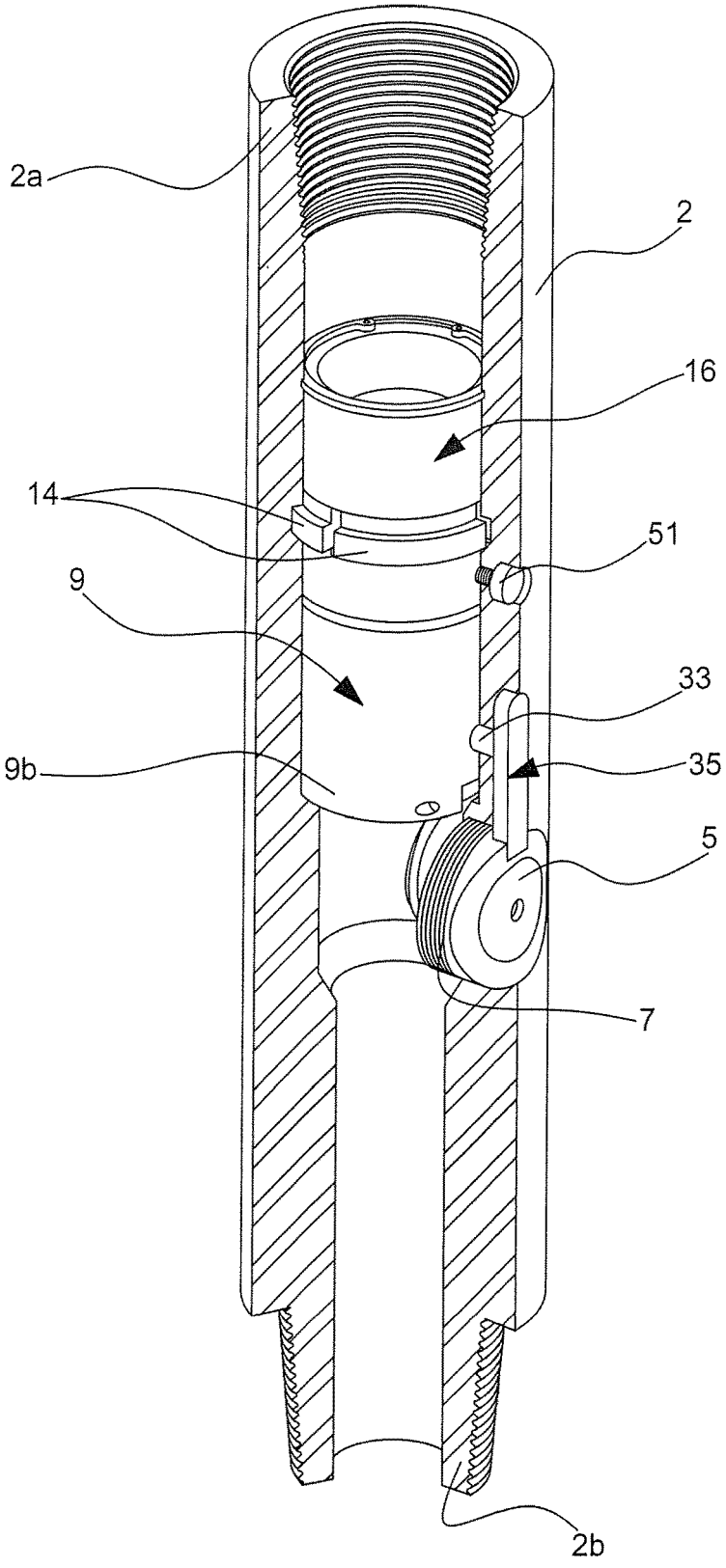
FIGS. 3 and 4 show two respective perspective longitudinal sectional views of the device of FIG. 2 as taken along two different planes.
Figure 4:
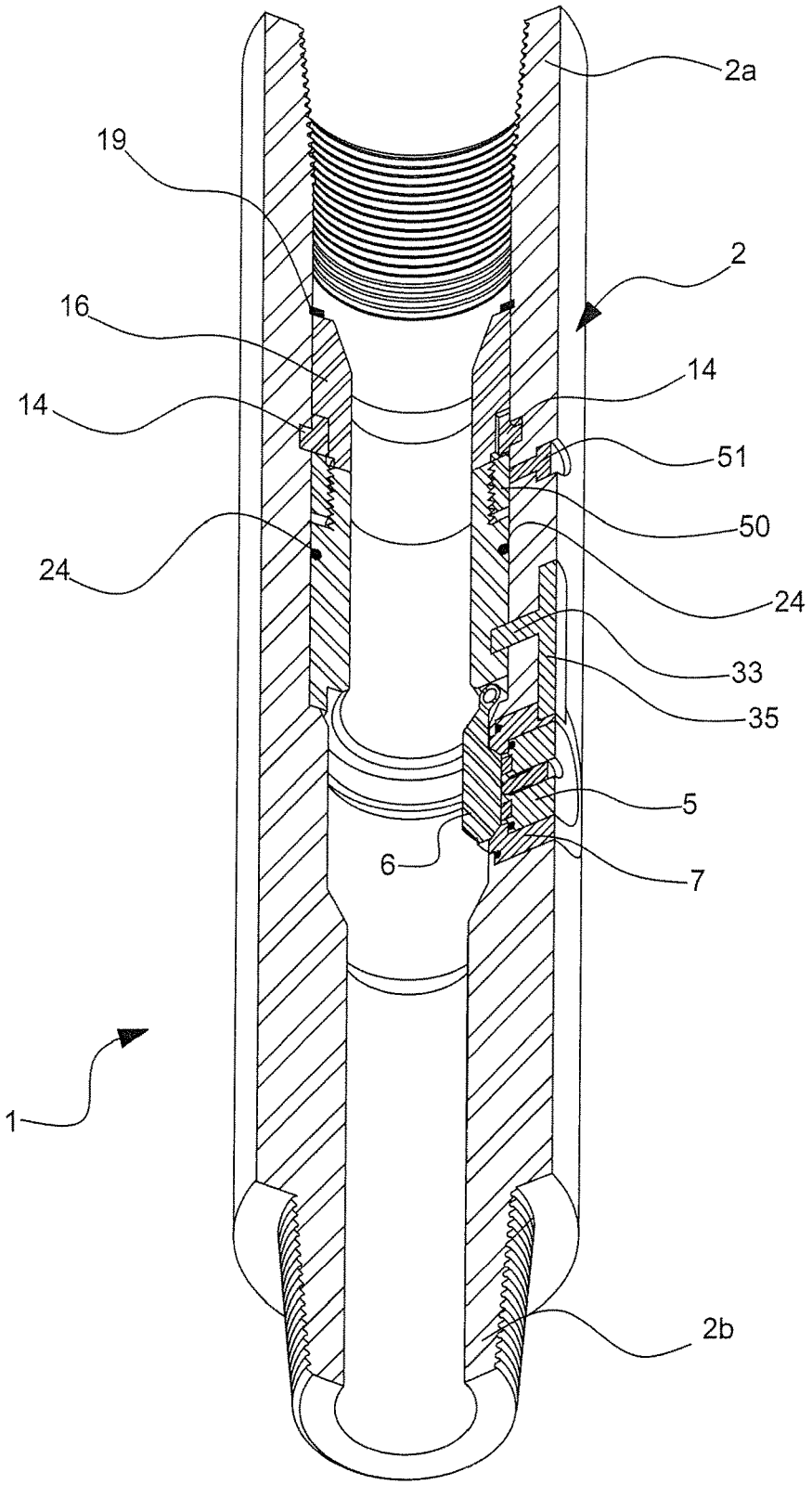
Figure 5:
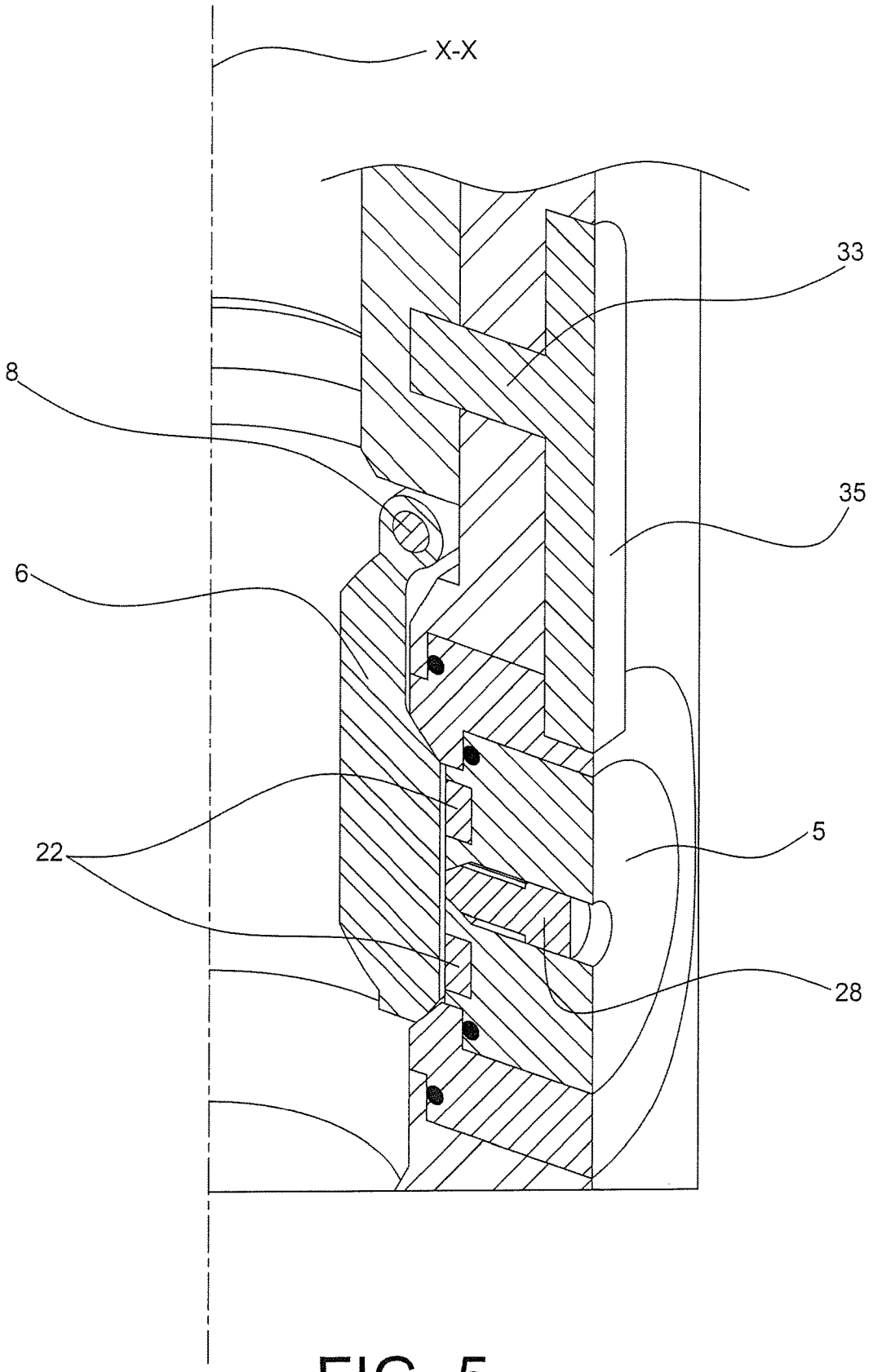
FIG. 5 shows an enlarged detail of FIG. 4.
Figure 6:
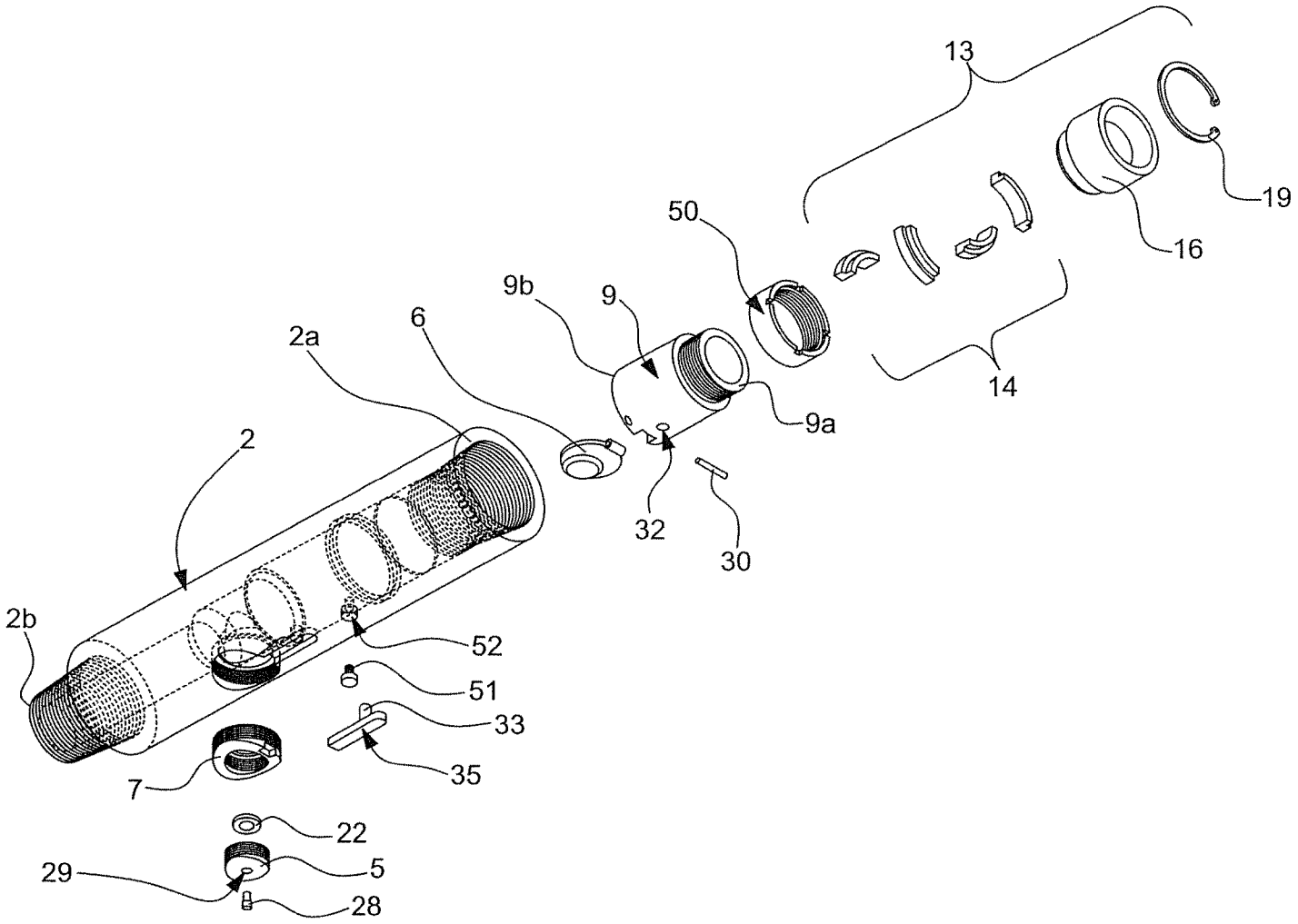
FIG. 6 shows an exploded perspective view of the device of FIG. 1.
Figure 7:
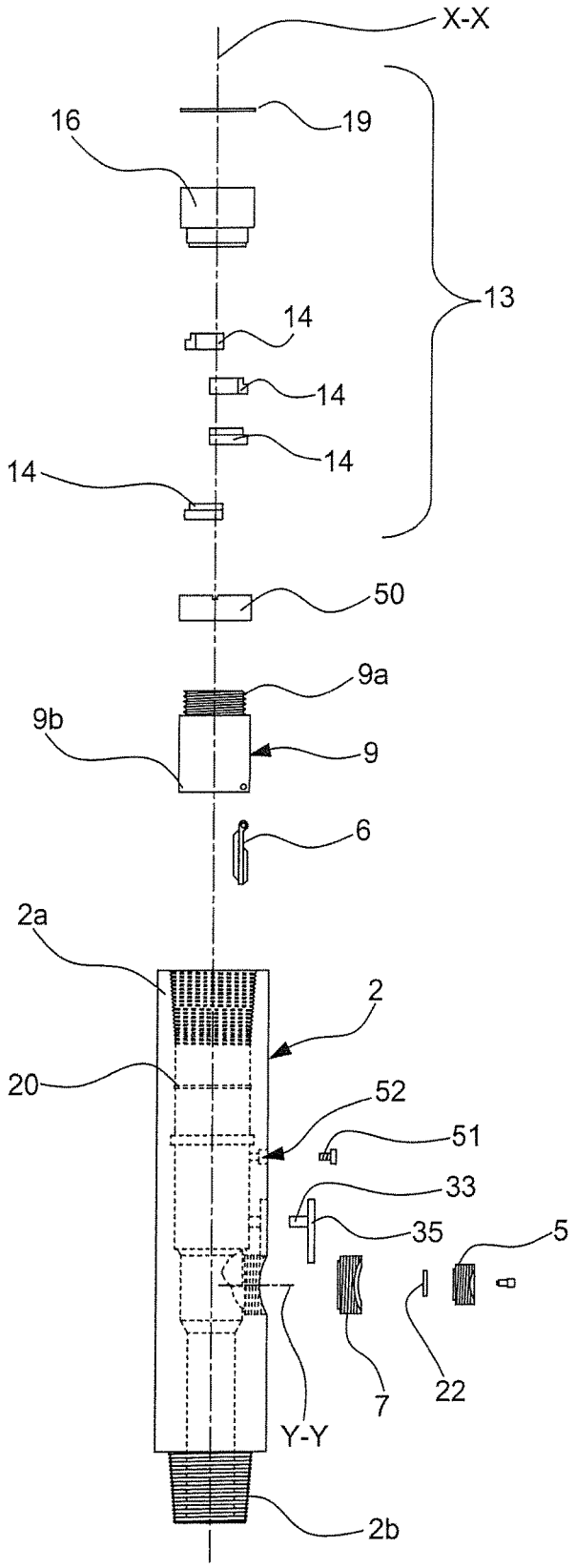
FIG. 7 shows an exploded plane view of the device of FIG. 1.
Figure 8:
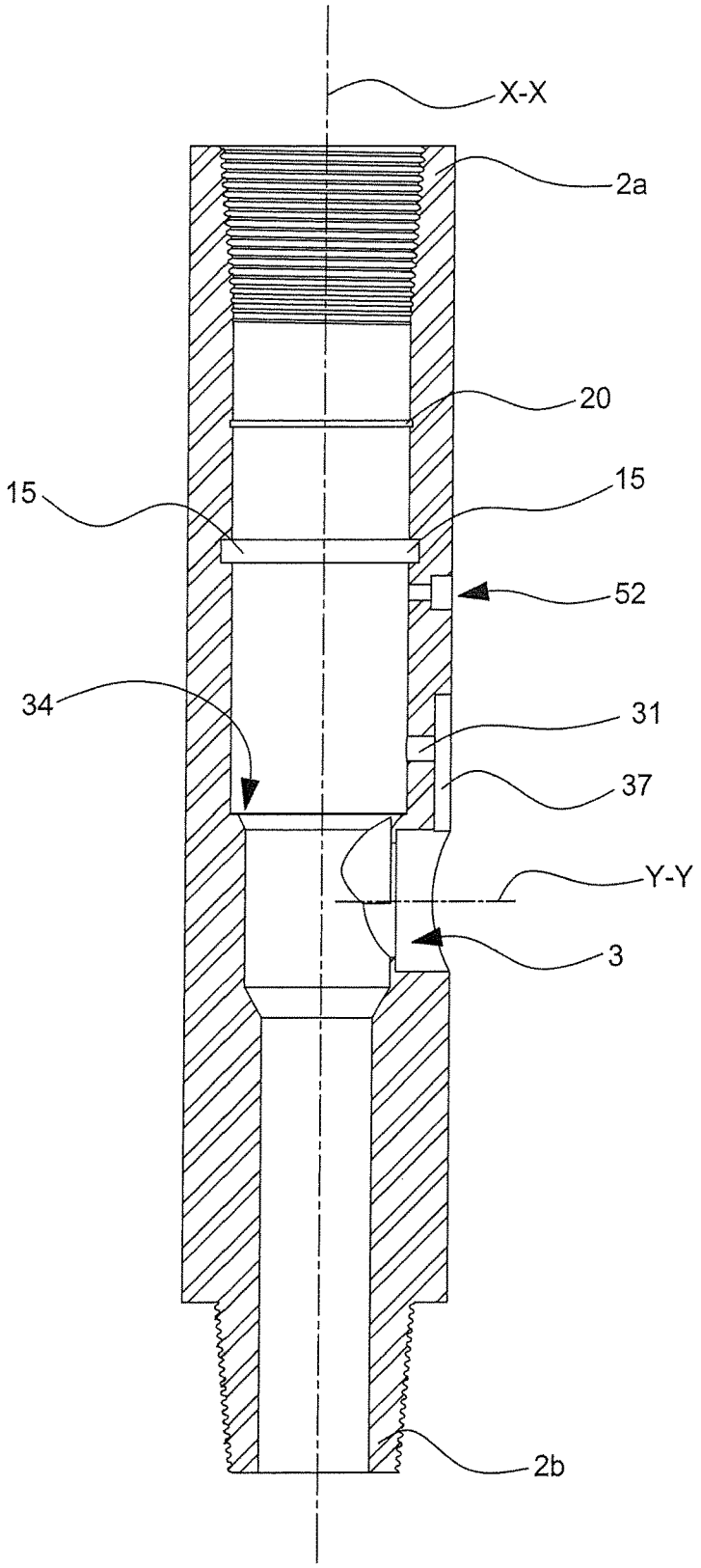
FIG. 8 only shows a longitudinal sectional plane view detail of the tubular body of the device of FIG. 1.

Possibly, the aforementioned magnetic means 22 may be arranged to be carried both by the plug 5 and by the shut-off member 6, in the latter case the magnets of the plug and the shut-off member should be arranged in substantially facing positions, for mutual magnetic attraction when the shut-off member 6 is in the aforementioned longitudinal position (see FIGS. 2, 4, 5).

Concerning the attractive force that attracts the shut-off member 6 toward the plug, it will be appreciated that such attractive force is useful during the transient steps in which the shut-off member 6 is carried from the aforementioned transverse position to the longitudinal position. Indeed, when the drilling mud flows along the axial channel from the end 2*a* to the end 2*b*, the mud flow itself pushes the shut-off member and holds it in the aforementioned longitudinal position. Therefore, the magnets 22 help the shut-off member 6 to adhere against the inserted seat 7 prior to the action of the inner pressure of the drilling mud.

Once the adapter has been mounted and the mud flow has been deflected from the axial to the radial direction, the flow will open the shut-off member without having to overcome any magnetic attraction, as magnets have already been removed with the plug (as they were joined to the plug).

Preferably there is no direct contact between the plug 5 and the shut-off member 6, a minimum distance being always ensured there between, to avoid that any residual mud might prevent the shut-off member from reaching the aforementioned longitudinal position (see FIGS. 2.4, 5), and hence to ensure tight sealing of the lateral opening.

As a result, when the shut-off member 6 is in the aforementioned longitudinal position (see FIGS. 2, 4, 5), a closed chamber is defined between the shut-off member 6 and the plug 5. In order to provide depressurization of such chamber, according to a preferred embodiment the plug 5 comprises a small axial through opening 29 at which a closed screw cap 28 is located, which is adapted to be actuated into a pressure-tight closed state and an open state, for respectively obstructing and allowing the passage of fluid through the aforementioned through opening, in the latter case allowing the passage of the drilling mud. Hence the axial through opening together with the screw cap 28 constitute a discharge valve.

Therefore, by opening the aforementioned discharge valve, any drilling mud retained thereby may be evacuated, which will improve the stability of the shut-off member in the longitudinal position (see FIGS. 2, 4, 5), and will ensure pressure-tight closure of the lateral passage.

Preferably, the aforementioned magnetic means 22 are applied to the plug 5 in such a manner as to circumscribe the aforementioned through opening that has the discharge valve located thereat.

As clearly shown in the above description, the device 1 of the present invention fulfills the aforementioned need and also obviates prior art drawbacks as set out in the introduction of this disclosure. The possibility of acting upon the adjustment pressing/pushing member to press and force the tubular support into the limit-stop position against the aforementioned positioning and centering means affords recovery of clearances due to processing tolerances, and allows the tubular support to assume a given well-precise axial position in the tubular body of the device, whereby the axial position of the shut-off member is also well-defined, and the shut-off member is optimally positioned relative to its respective shut-off member seats.

Advantageously, the provision of magnetic means housed in the inner annular seat of the tubular body allows the retainer elements to be held in position in the inner annular seat during assembly of the device, namely prior to positioning of the locking guide.

Those skilled in the art will obviously appreciate that a number of changes and variants may be made to the above described device, still within the scope of the invention, as defined in the following claims.

The invention claimed is:

1. A device for ensuring continuous circulation during well drilling, during insertion or removal of a drill string in wells for hydrocarbon exploration and production, the device comprising:

a substantially tubular body extending along a longitudinal axis in a preset axial direction from an upstream end to a downstream end;

the tubular body comprising an inner tubular wall;

an axial conduit extending in the tubular body from the upstream end to the downstream end which allows drilling mud to flow through the device;

first threaded connection means, at the upstream end, for connection of the upstream end of the device to one end of a drill string;

second threaded connection means, at the downstream end, for connection of the downstream end of the device to one end of another drill string;

a lateral opening provided in the tubular body, between the upstream end and the downstream end, to define a lateral conduit in the device in fluid communication with the axial conduit;

a plug removably fitted, in a pressure-tight manner by a threaded nut-screw engagement, into the lateral opening;

valve means comprising at least one shut-off member and located in the axial conduit to block the drilling mud and stop a flow of the drilling mud from the upstream end to the downstream end;

a tubular support concentrically inserted in a pressure-tight manner in the tubular body from the upstream end to an axial limit-stop position defined by positioning and centering means, and the valve means being carried by the tubular support to be removed from the tubular body; and retainer means to maintain the tubular support inserted in the axial conduit in the axial limit-stop position, and the retainer means comprise:

a plurality of retainer elements placed in the tubular body in a circumferentially offset position and close to a head end of the tubular support facing the upstream end of the tubular body, and the retainer elements acting as retainer means to prevent the tubular support from axially moving toward the upstream end of the tubular body;

an inner seat provided in the inner tubular wall of the tubular body in which a first portion of the retainer elements is housed; and a locking guide engaged with the inner tubular wall of the tubular body to maintain the first portion of the retainer elements within the inner seat;

wherein the retainer elements of the plurality of retainer elements are offset and circumferentially spaced along the inner seat from which the retainer elements project towards an inside of the tubular body with a second portion to define overall in the axial conduit of the tubular body an inner shoulder having a smaller inner diameter with respect to the inner diameter of the inner annular wall of the axial conduit of the tubular body;

an adjustment pressing/pushing member, the adjustment pressing/pushing member is coaxially associated in kinematic nut-screw engagement with the tubular support, so that a relative rotation either in a first direction or in an opposite direction of the adjustment pressing/pushing member with respect to the tubular support corresponds to a relative displacement in the axial direction, either in the first direction or in the opposite direction of the adjustment pressing/pushing member with respect to the tubular support;

following a relative rotation with respect to the tubular support, the adjustment pressing/pushing member reversibly moves in the axial direction, to pass from a retracted first position, spaced from the upstream end, towards an advanced second position with respect to the upstream end, and vice-versa;

in the retracted first position, the adjustment pressing/pushing member does not interfere with the retainer elements being spaced further from the upstream end of the tubular body with respect to the retainer elements;

the inner shoulder defined in the tubular body by the retainer elements defines a limit stop abutment to the movement of the adjustment pressing/pushing member towards the advanced second position; and the adjustment pressing/pushing member abuts with forcing against the inner shoulder defined in the tubular body to force the retainer elements in the inner seat towards the upstream end of the tubular body and, at the same time, to force the tubular support in the axial limit-stop position against the positioning and centering means, so as to allow recovery of clearances in the positioning inside the tubular body of the tubular support and of the valve means supported by the tubular support.

2. The device according to claim 1, wherein:

the adjustment pressing/pushing member is a threaded ring nut, and the head end of the tubular support facing towards the upstream end of the tubular body has a threading with which the threaded ring nut is coupled in a nut/screw engagement.

3. The device according to claim 1, comprising stop means acting on the adjustment pressing/pushing member to reversibly lock the angular position of the adjustment pressing/pushing member with respect to the tubular support, so as to prevent rotation, and a consequent axial displacement of the adjustment pressing/pushing member with respect to the tubular body.

4. The device according to claim 3, wherein the stop means comprise a locking pin which is inserted in a through opening formed transversally in the tubular wall of the tubular body, at the adjustment pressing/pushing member, and abuts with a predetermined pre-load against an outer wall of the adjustment pressing/pushing member to prevent the adjustment pressing/pushing member from rotating with respect to the axis, the locking pin is inserted either with forcing or through threaded nut/screw coupling in the through opening formed transversally in the tubular wall of the tubular body.

5. The device according to claim 1, wherein the retainer elements comprise circumferential sectors having a substantially L-shaped cross section, a first branch of the L-shaped cross section defines the aforementioned first portion inserted in the groove and a second branch of the L-shaped cross section defines the second portion that defines the inner shoulder, the adjustment pressing/pushing member acting on the second branch of the L-shaped cross section, the second branch of the L-shaped cross section extends from the first branch towards the upstream end of the tubular body.

6. The device according to claim 1, wherein the retainer elements comprise rollers positioned with respective axes arranged parallel to the longitudinal axis of the tubular body, and the rollers have a diameter of between 10 and 30 mm.

7. The device according to claim 1, wherein the retainer elements are either spherical or comprise spherical surface portions.

8. The device according to claim 1, wherein the inner seat comprises an inner profile matching a profile of the first portion of the retainer elements.

9. The device according to claim 1, wherein the inner seat is an annular seat.

10. The device according to claim 1, wherein the retainer elements are either magnetic or comprise magnetic fixing means.

11. The device according to claim 1, wherein magnets are housed in the inner seat to hold the retainer elements in position in the inner seat.

12. The device according to claim 1, wherein the locking guide is held in position in the tubular body by a Seeger ring.

13. The device according to claim 1, wherein:

the valve means comprise a shut-off member that is movably supported in the axial conduit to move from a position transverse to the axial conduit, in which the shut-off member extends transverse to an axis of the axial conduit to stop fluid continuity between the upstream end and the downstream end in the axial conduit, and a longitudinal position relative to the axial conduit, in which the shut-off member substantially extends along the axis of the axial conduit close to a side wall portion within the tubular body;

in the transverse position, the shut-off member is located between the lateral conduit and the upstream end of the tubular body to be placed upstream from the lateral opening, relative to the flow of the drilling mud in the axial conduit from the upstream end to the downstream end, and in the longitudinal position, the shut-off member closes in a pressure-tight manner the lateral opening to stop fluid continuity between the lateral conduit and the axial conduit.

14. The device according to claim 13, comprising magnetic means acting on the shut-off member when in the longitudinal position to hold the shut-off member in the longitudinal position with a predetermined magnetic force.

15. The device according to claim 13, wherein the shut-off member comprises a diaphragm connected via hinge connection means at a peripheral portion thereof to an axis of rotation, the diaphragm moving from the longitudinal position to the transverse position, and vice versa, by rotating about the axis of rotation, the axis of rotation:

extends transverse to the longitudinal axis of the axial conduit;

is placed close to the inner wall of the tubular body;

is circumferentially placed to be substantially located at the lateral opening; and is located substantially proximate to the lateral opening in a portion of the tubular body located between the lateral opening and the upstream end of the tubular body, such that, when the tubular body is placed with the longitudinal axis substantially in a vertical orientation, with the upstream end located at a higher level than the downstream end, the hinge connection means and the axis of rotation are placed above the through opening and, due to a weight force, the diaphragm tends to move toward the longitudinal position.

16. The device according to claim 1, wherein the positioning and centering means define a polarized insertion key, which is adapted to allow insertion of the tubular support into the axial conduit of the tubular body to the limit-stop axial position only when the tubular support reaches a proper angular orientation about the axis of the axial conduit.

17. The device according to claim 1, wherein the positioning and centering means comprise:

a through hole provided in the wall of the tubular body perpendicular to the longitudinal axis, a blind hole provided in an outer wall of the tubular support perpendicular to the longitudinal axis, and a pin adapted to fit into the through hole of the tubular body to engage in the blind hole of the tubular support.

18. The device according to claim 1, comprising an inserted seat for the shut-off member, which is integrally associated, in a pressure-tight manner, with the tubular body around the lateral opening, wherein the inserted seat for the shut-off member defines a threaded ring nut having:

an inner threaded portion that provides the threaded engagement with the removable plug, and an outer threaded portion that is engaged in a pressure-tight manner with the tubular body.

19. A device for ensuring continuous circulation at least during insertion or removal of a drill string in a well for hydrocarbon exploration and production, the device comprising:

a substantially tubular body extending along a longitudinal axis in a preset axial direction from an upstream end to a downstream end;

the tubular body comprises an inner tubular wall;

an axial conduit extending in the tubular body from the upstream end to the downstream end which allows drilling mud to flow through the device;

a first threaded connection, at the upstream end, for connection of the upstream end of the device to one end of a drill string;

a second threaded connection, at the downstream end, for connection of the downstream end of the device to one end of another drill string;

a lateral opening provided in the tubular body, between the upstream end and the downstream end, to define a lateral conduit in the device in fluid communication with the axial conduit;

a plug removably fitted, in a pressure-tight manner by a threaded nut-screw engagement, into the lateral opening;

a valve comprising at least one shut-off member and located in the axial conduit to block the drilling mud and stop a flow of the drilling mud from the upstream end to the downstream end;

a tubular support concentrically inserted in a pressure-tight manner in the tubular body from the upstream end to an axial limit-stop position defined by a positioning and centering mechanism, and the valve being carried by the tubular support to be removed from the tubular body; and a retainer for maintaining the tubular support inserted in the axial conduit in the axial limit-stop position, and the retainer comprising:

a plurality of retainer elements placed in the tubular body in a circumferentially offset position and close to a head end of the tubular support facing the upstream end of the tubular body, and the retainer elements acting as retainer to prevent the tubular support from axially moving toward the upstream end of the tubular body;

an inner seat provided in the inner tubular wall of the tubular body in which a first portion of the retainer elements is housed; and a locking guide engaged with the inner tubular wall of the tubular body to maintain the first portion of the retainer elements within the inner seat;

wherein the retainer elements of the plurality of retainer elements are offset and circumferentially spaced along the inner seat from which the retainer elements project toward an inside of the tubular body with a second portion to define overall in tubular body an inner shoulder which has a smaller inner diameter with respect to an inner diameter of the inner annular wall of the tubular body;

an adjustment pressing/pushing member, the adjustment pressing/pushing member is coaxially associated in a kinematic nut-screw engagement with the tubular support so that a relative rotation, either in a first direction or in an opposite second direction of the adjustment pressing/pushing member with respect to the tubular support, corresponds to a relative displacement in the axial direction, either in the first direction or in the opposite second direction of the adjustment pressing/pushing member with respect to the tubular support;

following a relative rotation with respect to the tubular support, the adjustment pressing/pushing member reversibly moves in the axial direction, to pass from a retracted first position spaced from the upstream end towards a advanced second position with respect to the upstream end, and vice-versa;

in the retracted first position, the adjustment pressing/pushing member does not interfere with the retainer elements being spaced further from the upstream end of the tubular body with respect to the retainer elements;

the inner shoulder defined in the tubular body by the retainer elements defines a limit stop abutment to the movement of the adjustment pressing/pushing member towards the advanced second position; and the adjustment pressing/pushing member abuts with forcing against the inner shoulder defined in the tubular body to force the retainer elements in the inner seat towards the upstream end of the tubular body and, at the same time, to force the tubular support in the axial limit-stop position against the positioning and centering mechanism, so as to allow recovery of clearances in the positioning inside the tubular body of the tubular support and of the valve supported by the tubular support.

* * * * *